United States Patent [19]

Pereyra

[11] Patent Number: 4,760,919

[45] Date of Patent: Aug. 2, 1988

[54] TAMPER-INDICATING PACKAGE

[75] Inventor: Rodger J. Pereyra, Cottage Grove, Minn.

[73] Assignee: Minnesota Mining and Manufacturing Company, St. Paul, Minn.

[21] Appl. No.: 79,648

[22] Filed: Jul. 30, 1987

[51] Int. Cl.[4] ..... B65D 73/00

[52] U.S. Cl. ..... 206/484.2; 206/524.2; 206/807

[58] Field of Search ..... 206/484, 484.2, 484.1, 206/524.2, 807

[56] References Cited

U.S. PATENT DOCUMENTS

| | | | |
|---|---|---|---|
| 2,588,067 | 3/1952 | Whitehead | 40/2.2 |
| 2,835,993 | 5/1958 | Whitehead | 40/2.2 |
| 3,450,256 | 6/1969 | Chandler et al. | 206/78 |
| 4,228,215 | 10/1980 | Hein, III et al. | 206/484 |
| 4,324,421 | 4/1982 | Moraw et al. | 283/7 |
| 4,389,472 | 6/1983 | Neuhaus et al. | 430/10 |
| 4,429,015 | 1/1984 | Sheptak | 428/201 |
| 4,456,667 | 6/1984 | Bochow et al. | 430/10 |
| 4,469,353 | 9/1984 | Anarwala | 283/74 |
| 4,506,914 | 3/1985 | Gobeli | 283/70 |
| 4,509,196 | 4/1985 | Sak et al. | 383/5 |
| 4,516,679 | 5/1985 | Simpson et al. | 206/807 |

*Primary Examiner*—William Price

*Attorney, Agent, or Firm*—D. M. Sell; David L. Weinstein

[57] ABSTRACT

Tamper-indicating package comprising two webs, each of which comprises an outer layer of polymeric material and an inner layer of polymeric material. At least one of said inner layer or said outer layer of at least one of said webs bears a random pattern of markings. Upon access to the interior of the package, either the random pattern of markings will be altered or one or both of the polymeric layers will be damaged, thus indicating that the package has been subject to tampering.

12 Claims, 2 Drawing Sheets

TAMPER-INDICATING PACKAGE

BACKGROUND OF THE INVENTION

This invention relates to packages, and, more particularly, to packages having a means for detecting unauthorized tampering therewith.

It is frequently desired by corporations or government agencies to transmit confidential or secret documents from one location to another. From the time the documents leave the sender to the time they are received by the recipient, the documents are subject to being temporarily removed from their container, duplicated, and replaced in their original container or in an identical container by unauthorized third parties in such a way that the sender and receiver have no knowledge that the confidentiality or secrecy of the documents has been compromised. The ramifications of this breach of confidentiality are well-known.

Accordingly, it would be desirable to provide an inexpensive, easy-to-use, tamper-indicating package for the transmission of confidential or secret documents.

SUMMARY OF THE INVENTION

This invention involves a tamper-indicating package comprising two webs, each of which comprises (1) an outer layer of polymeric, e.g. thermoformable, material, and (2) an inner layer of polymeric material, at least one of these layers of at least one of these webs having marks thereon disposed in a random pattern so that either said random pattern will be altered upon access to the interior of said package or said marked polymeric layer will be damaged. A document or other article can be placed between the webs, and the margin of the webs sealed to form the package. The webs of the resulting package are then imaged to provide pictures of the unique random pattern. Comparison of the pictures of the webs with the delivered package will indicate whether a party other than the sender or receiver has gained access to the contents of the package.

DETAILED DESCRIPTION

Figure 1:
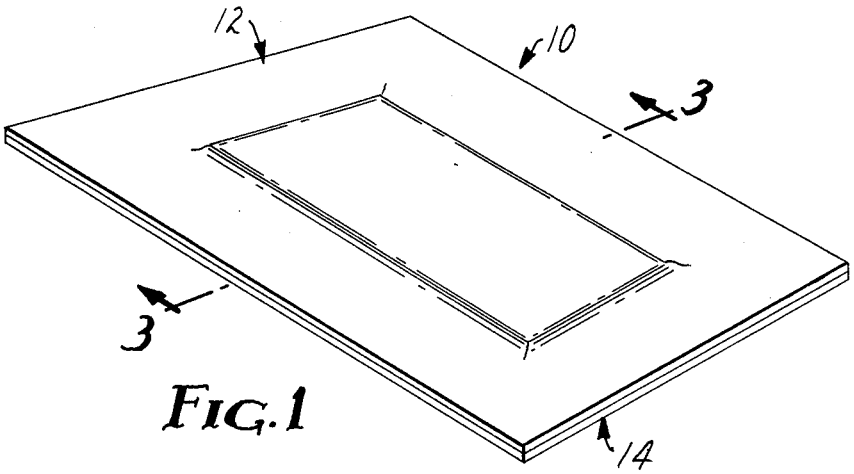
FIG. 1 is a perspective view of the preferred embodiment of the sealed package of this invention.
Figure 2:
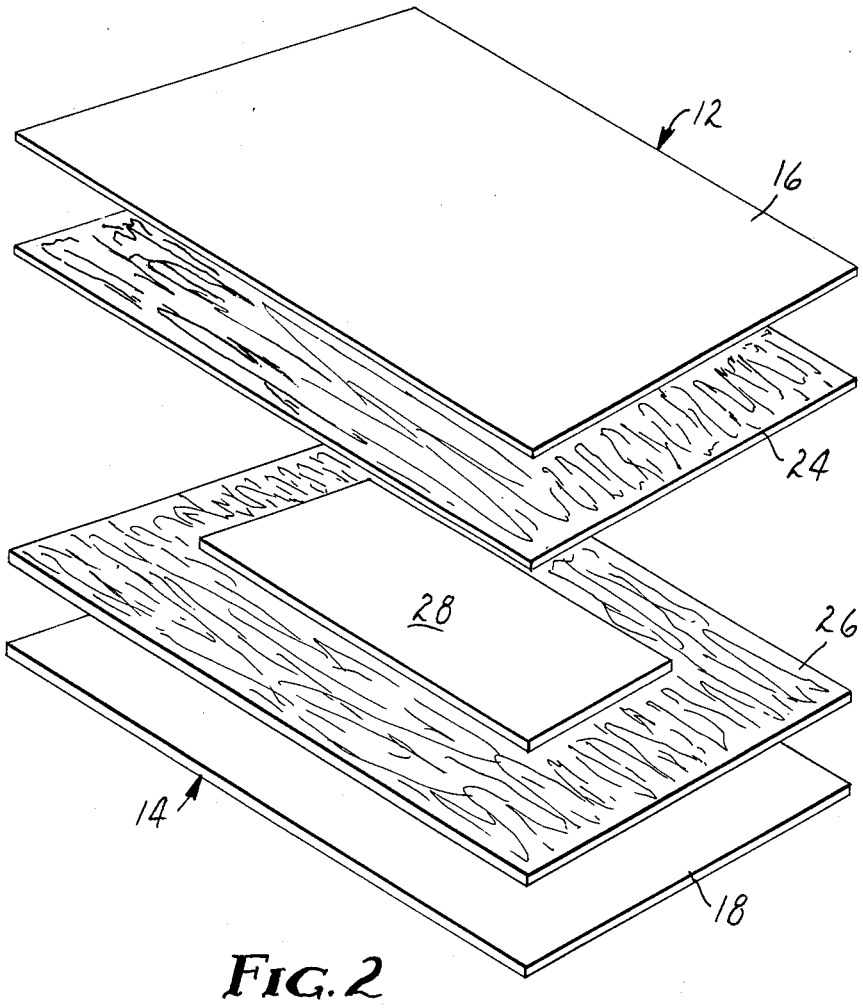
FIG. 2 is an exploded perspective view of the preferred embodiment of the package of this invention.
Figure 3:
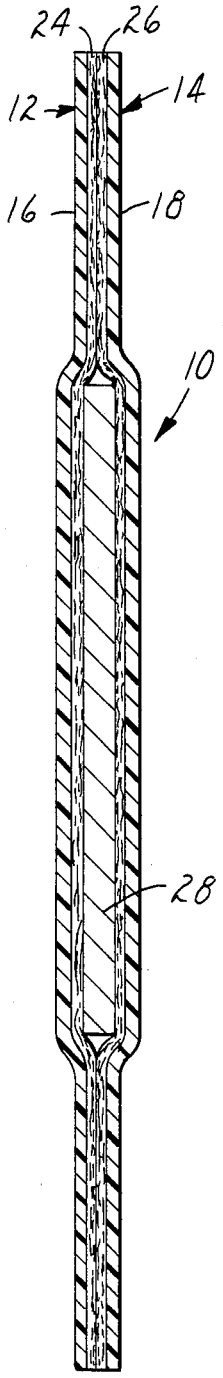
FIG. 3 is a sectional view taken along line 3—3 of FIG. 1.

With reference to FIGS. 1, 2, and 3, the package 10 of this invention is formed from first and second coextensive webs 12 and 14. Although webs 12 and 14 are shown as two distinct coextensive webs, it is within the scope of this invention that webs 12 and 14 be formed of a single web having two symmetrical halves, whereby the package can be formed by folding one half of the web over the other half of the web and then sealing the one half to the other half. The webs are preferably rectangular in shape. However, other shapes, e.g. circular, polygonal, can be used.

Each web of the preferred embodiment comprises an outer layer 16 and 18 made of a polymeric, e.g. thermoformable, material. The material of the outer layer can serve to provide rigidity to the package. Materials that are suitable for forming layers 16 and 18 include polyvinyl chlorides, polystyrenes, polycarbonates, ethylene vinyl acetate, cellulosics, e.g. cellulose acetate, cellulose propionate, cellulose butyrate. Representative examples of commercially available materials suitable for the outer layer include "Geon" polyvinyl chloride, available from The B. F. Goodrich Co. and "US 1002" polyvinyl chloride, available from American Hoechst Corp. The thickness of layers 16 and 18 can vary, with typical thicknesses ranging from about two mils to about ten mils. Layers 16 and 18 are transparent to whatever type of radiation is used for preparing the image of the random pattern for detection of tampering.

Each web of the preferred embodiment further comprises an inner layer 24 and 26. Layers 24 and 26 are sealed to each other in order to close the package. Layers 24 and 26 are bonded to layers 16 and 18, respectively, typically by means of a suitable laminating procedure. Materials that are suitable for forming layers 24 and 26 include heat sealable materials such as low density polyethylene, linear low density polyethylene, high density polyethylene, ethylene ionomers, ethylene vinyl acetate copolymers, and polyamides. Representative examples of commercially available materials suitable for the inner layer include "Elvax 260" ethylene vinyl acetate, available from E. I. duPont de Nemours and Co., Inc. and "Surlyn 1601" ionomer, available from E. I. duPont de Nemours and Co., Inc. Heat sealable materials that are difficult to laminate to outer layers 16 and 18 can be used if an adhesion promoting material, e.g. an adhesive, is incorporated between the inner and outer layers. Whether or not inner layers 24 and 26 are made of heat sealable materials, an adhesive can be used, in lieu of a heat sealing process, to seal inner layers 24 and 26 to each other to close the package. The thickness of layers 24 and 26 can vary, with typical thicknesses ranging from about two mils to about ten mils. Layers 24 and 26 preferably have the same transparency specifications as layers 16 and 18.

At least one of the layers 16, 18, 24, and 26 in at least one of the webs 12, 14 must be marked in such a way that a random pattern will be visible when the web is viewed. The marks may be in any form, such as, for example, streaks, dots, blots, so long as the pattern is random. The marks can be applied in a number of ways, such as, for example, applying dyes or pigments, normally during preparation of the polymeric layer, or applying ink, as from an ink jet printer. It is also within the scope of this invention to provide a random pattern to a given layer simply by means of preparing that layer from a blend of polymers, wherein the polymers have different indices of refraction. Upon viewing of that layer, a random pattern can be seen. Preferably, the marking is effected by application of dyes or pigments. It has been found that excellent random patterns can be generated in the inner layers 24, 26 or in the outer layers 16, 18 by introducing dyes or pigments into the melt from which layers are cast, extruded, or otherwise formed. Commercially available pigments that are suitable for use in the present invention include D1383, D1915, D1324 pigments, available from Ciba-Geigy Corporation. The marks are disposed in a random pattern such that the pattern is essentially impossible to duplicate. This pattern will serve as the unique "fingerprint" of the package. As used herein, the term "random" means having complete lack of design, intent, plan, or prearrangement. The marks must be of a color and optical density so that the package will be amenable to being imaged by the method of imaging desired by the user. It is preferred that the marks allow at least 70% optical transmission, i.e. at least 70% of the radiation incident on the web must be capable of passing through the web. It is also preferred that the marks be of a contrasting color to the layers of the web, in order to insure both ease in viewing and examining the pattern formed by them. It is further preferred that the document surface and the marked web be of sufficient contrast that the person or apparatus responsible for detection of tampering be able to discern the pattern.

It is preferred to seal layers 24 and 26 to each other by means of a margin, circumscribing the package, of sufficient width so that the possibility of reaching the enclosed contents by entering the package by separating webs 12 and 14 by peeling apart the seal formed by layers 24 and 26 without defacing the margin is nullified. In other words, as the width of the margin increases, the probability of defacing the material of the margin by peeling apart the seal formed by layers 24 and 26 also increases. Typical margin widths can range from about $\frac{3}{8}$ in. to about 1 in., preferably from about $\frac{5}{8}$ in. to about $\frac{3}{4}$ in.

The preferred method of preparing the package of this invention comprises a continuous process in which inner layers 24 and 26 are melt extruded onto outer layers 16 and 18, respectively. The polymeric material for preparing each inner layer 24 and 26, which material is normally in the form of pellets, is first mixed with pellets containing dye or pigment. The resulting mixture is then introduced into an extruder where the temperature is controlled, thereby melting the polymeric material. It is preferred that the polymeric material melt near the neck of the extruder under such conditions that it is impossible to achieve complete and intimate mixing of the dye or pigment with the polymer melt. This incomplete mixing will result in a streaked, or marbleized, appearance on the layer when it exits the die lip. An example of the weight ratio of dye or pigment pellets to pellets of polymeric material is 10 g dye or pigment pellets to 1500 g polymeric material.

Alternatively, the pigment can be added to the bulk polymer and dispersed therein by means of a screw auger. With a screw auger, both pellets of polymeric material and dye pellets or pigment pellets are fed directly into the throat of the extruder. Another method involves the employment of static mixing, wherein two extruders, one to feed the bulk of pellets of polymeric material and the other to feed molten dye or pigment pellets into the neck of the first extruder are required. Static mixers are generally located at the neck of the first extruder. By varying the length and number of static mixers, the degree of mixing can be controlled. The rates of both extruders can be controlled independently to provide control of color level and intensity, as is normally done in the screw auger arrangement. Melt extrusion processes are discussed thoroughly in Encyclopedia of Polymer Science and Technology, Vol. 8, Interscience Publishers, John Wiley & Sons, Inc. (New York: 1968) pp. 533–586, particularly pp. 554–563, incorporated herein by reference. Melt extrusion processes are well-known to those of ordinary skill in the art.

Dye or pigment pellets that are preferred for the extrusion methods are spherical or cylindrical in shape, having a diameter ranging from 0.125 to 0.25 inch, and having a colorant loading of 19% to 36%. It is preferred that the melt indices of the polymer in the polymer melt and pellets of colorant differ sufficiently in order impede intimate mixing. Preferably, the melt index of the polymer in the polymer melt ranges from about 5.3 to about 6.7 g/10 min. and the melt index of the pellets of colorant ranges from about 21 to about 40 g/10 min. Melt index is measured in accordance with ASTM D 1238-86.

The outer layer can be marked in the extrusion process or the inner layer can be marked during the extrusion process, or both the inner layer and the outer layer can be marked during the extrusion process.

Webs are generally prepared by means of a conventional coating-lamination process, such as that described in Encyclopedia of Polymer Science and Technology, Vol. 6, Interscience Publishers, John Wiley & Sons, Inc. (New York: 1967), pp. 764–794, particularly p. 777, incorporated herein by reference. Generally, the hot melt is bonded to the base film by its latent heat and nip roll pressure. This manner of forming the laminate of the web is well-known to those of ordinary skill in the art. It is preferred that at least one of the webs be formed (i.e. molded), preferably by means of thermal energy, so as to create a compartment for securely holding documents or other articles.

Figure 4:
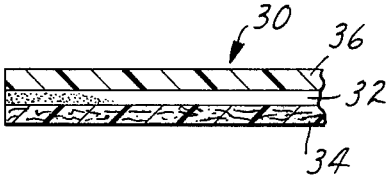
FIG. 4 is a sectional view of a second embodiment of a web of the package of this invention.

In another embodiment of the web 30, as shown in FIG. 4, an adhesion promoting material 32 can be introduced between inner polymeric layer 34 and outer polymeric layer 36. The adhesion promoting material, which is in the form of a layer, is preferably used when the inner polymeric layer and the outer polymeric layer will not bond except at extremely high temperatures. If desired, the adhesion promoting layer can have marks disposed in a random pattern thereon. An example of suitable adhesion promoting material is ethylene vinyl acetate.

It is also possible, but not economically desirable, to apply additional polymeric layers over outer layers 16, 18. These additional layers can serve as the random-patterned mark-bearing layers. As used herein, however, the term "outer layer" includes any layer that is not an inner layer. The term "inner layer" is intended to mean those layers that are sealed together to each other to form and close the package.

OPERATION

The webs used to illustrate the operation of the package of this invention comprise an outer layer made of poly(vinyl chloride) (PVC) and an inner layer made of "Surlyn" resin (an ionomer resin, i.e. a thermoplastic polymer that is ionically cross-linked). The inner layer has been marked with a random pattern by means of a colorant wherein the colorant has been randomly dispersed throughout the inner layer to provide a streaked pattern to the web.

The contents 28, for example, punch cards, are placed in the recess formed in webs 12 and 14. Web 14 is placed in register with web 12, and the two webs are fused by means of sealing inner layers 24 and 26 together, preferably by means of heat. Heat sealers that are useful for preparing the packages of this invention include impulse heat sealers and hot bar heat sealers. Typical operating conditions for hot bar heat sealers are 400° F. for a period of 5 to 10 seconds at a pressure of 90 psig. A commercially available sealer suitable for preparing the package of this invention is the "Sentinal" heat sealer. The margin is very wide, for example, about $\frac{3}{8}$ in. to about 1 in., while the length of the edges of the package is very small, for example, about 0.012 in. to about 0.018 in.

As used herein, the term "length of the edge" means the shortest distance extending from the outer layer 16 of web 12 to the outer layer 18 of web 14, as measured through a point on the surface of the margin nearest the edge. In other words, the length of the edge of a given package is the sum of the thicknesses of each layer comprising the package. If one were to thrust a sharp object into the edge of the package in an effort to peel apart the two webs 12 and 14 to gain access to the contents thereof, he would almost certainly deface the package in the area of the margin before he could contact the documents. For example, it would be virtually impossible to thrust a sharp object into the edge formed by layers 16, 18, 24, 26 while keeping the sharp object essentially parallel to layers 16, 18, 24, 26 so as not to deface the margin. By departing from the parallel direction by only an extremely small angle, the sharp object would puncture the margin, and this puncture would be visible to the unaided eye. Moreover, more than negligible tampering with the package would very likely alter the "fingerprint" formed by the random pattern.

Prior to sending the sealed package, the sender would prepare an image of each of the webs of the package. Imaging can be conducted by photographic means, photocopying means, laser scanning means, optical scanning means, infrared photographic means, ultraviolet scanning means, by densitometer, etc. The print of the image can be sent via electronic transmission or mail to the receiving location. In order to determine whether the package has been tampered with, the recipient can compare the images prepared by the sender with the random patterns formed on the web. If the images and the patterns do not match, the sender and receiver will be aware of tampering by means of package destruction and replacement thereof and can void the contents compromised. Furthermore, if the margin showed any signs of being defaced, the receiver will be aware of tampering and subsequent resealing of the original package.

The following, non-limiting example further illustrates the present invention.

EXAMPLE 1

Ten grams of colorant (Hercules Imperial D1324) were dry mixed with 1500 grams of ethylene vinyl acetate ("Elvax 260", available from the E. I. duPont de Nemours Co., Inc.) and added to a 1.75 inch "Prodex" extruder running at 20 rpm. A 1:1 compression metering screw having a 0.25 inch depth and a length-to-diameter ratio of 24 was used to extrude the mixture. The extrusion die was 12 inches wide and had feed, transition, and meter zones of uniform depth. The temperature profile across the extruder screw was maintained from 275° F. to 360° F. The temperature of the die was maintained at 380° F. The polymer melt was extruded onto 12 inch wide, 5 mil thick, rigid poly(vinyl chloride) film (US 1002, available from American Hoechst Corp.). The extrusion rate and web speed were adjusted and controlled to produce a coated layer 3 mils in thickness. Lamination of the inner layer and outer layer to form the web was effected by the heat of the polymer melt and pressure from nip rolls.

The finished web was then subjected to a thermoforming process to provide a pouch having a depth of from $\frac{1}{8}$ in. to $\frac{1}{2}$ in., a length of 6 in., and a width of 4 in. A group of cards having dimensions of 3 in. × 5 in. were placed in the pouch. A second layer of the finished web that has not been subjected to the thermoforming process was sealed to the pouch-containing web around the perimeter thereof with a Sentinal heat sealer.

The thus-formed container can then be imaged by means of conventional photography or xerography.

Various modifications and alterations of this invention will become apparent to those skilled in the art without departing from the scope and spirit of this invention, and it should be understood that this invention is not to be unduly limited to the illustrative embodiments set forth herein.

What is claimed is:

1. A tamper-indicating package comprising first and second generally coextensive webs marginally joined together to define said package, each of said webs being a laminate comprising an inner layer of polymeric material, an outer layer of polymeric material, said webs being joined together by means of a seal so as to form a margin circumscribing the package, at least one of said inner layer or outer layer of at least one of said webs bearing a random pattern of markings.

2. A package according to claim 1 wherein said outer layer is made of thermoformable material.

3. A package according to claim 1 wherein said outer layer comprises a material selected from the group consisting of poly(vinyl chloride), cellulosics, and polystyrene.

4. A package according to claim 1 wherein said inner layer is made of a heat sealable material.

5. A package according to claim 1 wherein said inner layer comprises a polymer selected from the group consisting of polyethylene, ethylene vinyl acetate, and ionomer resin.

6. A package according to claim 1 wherein said randomly disposed markings form an imageable pattern that will be altered when the marginal seal joining the webs of the package is the subject of tampering.

7. A package according to claim 1 further including an adhesion promoting material disposed between said inner layer and said outer layer of at least one of said webs.

8. A package according to claim 7 wherein said adhesion promoting material comprises a layer of polymeric material bearing a random pattern of markings.

9. A package according to claim 1 wherein said markings are provided by a colorant.

10. A package according to claim 9 wherein said colorant has a melt index that differs from the melt index of the polymer that comprises the layer in which said colorant is disposed.

11. A package according to claim 9 wherein said colorant is a dye or a pigment.

12. A package according to claim 1 wherein said markings are provided by blending two or more polymers having different indices of refraction.

* * * * *